US008752868B2

(12) United States Patent
Kim

(10) Patent No.: US 8,752,868 B2
(45) Date of Patent: Jun. 17, 2014

(54) LOCKING DEVICE FOR WINDOWS

(75) Inventor: Jeong Hwan Kim, Busan (KR)

(73) Assignees: Jeong Hwan Kim, Busan (KR); Soo Cheol Kim, Ulsan (KR); Kum Cheol Kim, Ulsan (KR)

( * ) Notice: Subject to any disclaimer, the term of this patent is extended or adjusted under 35 U.S.C. 154(b) by 584 days.

(21) Appl. No.: 13/054,207

(22) PCT Filed: Jul. 9, 2009

(86) PCT No.: PCT/KR2009/003760
§ 371 (c)(1),
(2), (4) Date: Jan. 14, 2011

(87) PCT Pub. No.: WO2010/011041
PCT Pub. Date: Jan. 28, 2010

(65) Prior Publication Data

US 2011/0127779 A1 Jun. 2, 2011

(30) Foreign Application Priority Data

Jul. 23, 2008 (KR) ..... 10-2008-0071442
Jul. 31, 2008 (KR) ..... 10-2008-0074899
Nov. 19, 2008 (KR) ..... 10-2008-0115245
May 12, 2009 (KR) ..... 10-2009-0041199

(51) Int. Cl.
*E05C 1/12* (2006.01)
*E05C 1/06* (2006.01)

(52) U.S. Cl.
USPC ..... 292/173; 292/143; 292/DIG. 20; 292/DIG. 46; 292/DIG. 47

(58) Field of Classification Search
USPC ..... 292/173, 161, 163, 169.17, DIG. 35, 292/DIG. 44, DIG. 47, DIG. 46, DIG. 20
See application file for complete search history.

(56) References Cited

U.S. PATENT DOCUMENTS 179,720 A * 7/1876 Morsell ..... 292/173
621,600 A * 3/1899 Caldwell ..... 292/173
(Continued)

FOREIGN PATENT DOCUMENTS

JP 63-148778 U 9/1988
JP 58-113519 U 8/1993
(Continued)

OTHER PUBLICATIONS

International Search Report, Appln No. PCT/KR2009/003760, dated Mar. 9, 2010.

*Primary Examiner* — Kristina Fulton
*Assistant Examiner* — Faria Ahmad
(74) *Attorney, Agent, or Firm* — Novick, Kim & Lee, PLLC; Jae Youn Kim

(57) ABSTRACT

The locking device for a window comprises a window side-locking unit which is installed in the window and a window frame side-locking unit which is installed in the window frame. For preventing intruder access to the window, a stop member of the window frame side-locking unit contacts a holding member of the window side-locking unit through vertical movement thereof in order to restrict the movement of the window. According to the present invention, the locking apparatus for the window comprises the window side-locking unit which is installed in the window and the window frame side-locking unit which is installed in the window frame. The stop member of the window frame side-locking unit contacts the holding member of the window side-locking unit through vertical movement.

3 Claims, 12 Drawing Sheets

(56) References Cited

U.S. PATENT DOCUMENTS

| | | | | | |
|---|---|---|---|---|---|
| 744,473 | A | * | 11/1903 | Buchanan | 292/173 |
| 1,139,706 | A | * | 5/1915 | Newpher | 292/173 |
| 1,171,775 | A | * | 2/1916 | Downing | 292/173 |
| 1,598,917 | A | * | 9/1926 | List | 292/173 |
| 1,616,189 | A | * | 2/1927 | Hjert | 292/173 |
| 1,857,295 | A | * | 5/1932 | Ehret | 292/173 |
| 3,085,300 | A | * | 4/1963 | Carlston | 49/450 |
| 3,151,907 | A | * | 10/1964 | Morgan | 296/97.9 |
| 3,166,347 | A | * | 1/1965 | Andrews | 292/202 |
| 4,102,545 | A | * | 7/1978 | Jay | 292/57 |
| 4,639,022 | A | * | 1/1987 | Dunphy et al. | 292/150 |
| 4,699,406 | A | * | 10/1987 | Swanson, Jr. | 292/175 |
| 5,715,631 | A | * | 2/1998 | Kailian et al. | 49/450 |
| 6,607,221 | B1 | * | 8/2003 | Elliott | 292/33 |
| 6,709,031 | B1 | * | 3/2004 | Michael | 292/138 |

FOREIGN PATENT DOCUMENTS

| | | | |
|---|---|---|---|
| KR | 20-0183381 | A | 3/2000 |
| KR | 20-0196853 | Y1 | 9/2000 |
| KR | 10-0309144 | B1 | 11/2001 |
| KR | 10-2005-0094727 | A | 9/2005 |
| KR | 20-0413121 | Y1 | 4/2006 |
| KR | 10-0724309 | B1 | 6/2007 |
| KR | 10-2009-0123753 | A | 12/2009 |

* cited by examiner

LOCKING DEVICE FOR WINDOWS

TECHNICAL FIELD

The present invention relates to a locking device for windows, and more particularly, to such a locking device for windows, which simply implements the constitution for performing a locking function while maintaining the technical spirit of a window device having an anti-crime function proposed through an earlier application by the present inventor, so that it can be more easily applied to various types of windows and window frames.

BACKGROUND ART

As multi-residential houses such as apartments, tenements, buildings, and the like come into spotlight as centric dwelling spaces with an increase in the population density due to urbanization, the importance of anti-crime measures for the residential spaces is growing. In particular, in case of the lower floors of the detached houses or multi-residential houses, installation of lattice supports for preventing crimes is generalized due to necessity of the crime prevention for windows.

However, in the case where such lattice supports are installed in windows, continuous maintenance and repair thereof is required. In addition, there is encountered a problem in that the windows cannot be utilized at an emergency time such as occurrence of fires as well as in a daily life. Also, there is involved a problem in that a field of outdoor vision is obstructed and aesthetic appearance of the windows is poor.

Therefore, a window including a locking device has been devised in place of a window with lattice supports for prevention of crimes. As one example of a technology related with the window including such a locking device, Korean Utility Model Registration No. 20-0183381 entitled "A Window Including Crime-Preventing Means" has been proposed. The window including the crime-preventing means is constructed such that a typical sliding window opened/closed in a horizontal or vertical sliding manner selectively includes a plurality of sliders configured to perform an anti-crime function, a plurality of linkages connected to the sliders by means of shaft pins to ascend the sliders, and a frame configured such that the sliders and the linkages are guided along the frame upon the ascending of the sliders and the folding of the linkages. The lowermost slider of the sliders includes a stopper fixed to one side of a window frame to be opened and a sliding slot configured such that the stopper is selectively retained by the sliding slot and slides along the sliding slot to restrict the descending/descending of the slider. Thus, an anti-crime function can be performed even in a state in which one side of the window is partially or fully opened.

In addition, there have been proposed Korean Utility Model Registration No. 20-0413121 entitled "Assembly of Sliding Window Including Security Window", Korean Patent Laid-Open Publication No. 10-2005-0094727 entitled "Crime-Preventing Window Structure Openable/Closable in The Room in Case of Fire", and Korean Patent No. 10-0724309 entitled "Anti-Crime Window Frame Structure for Architecture Complex".

However, the conventional window including the locking device for prevention of crimes entails a problem in that its construction is inevitably complicated in order to implement the combined locking and unlocking function for prevention of crimes in a window, thus making it difficult to maintain/repair the window. In addition, there is caused a problem in that a user suffers from an inconvenience of having to lock/unlock the window. Also, in order to prevent the movement of the window in a state in which the window mounted in the window frame is closed or is partially opened at a specific position, since the user always operates a locking device implemented in the window personally to cause the window to be locked, he or she suffers from an inconvenience of having to secure the window. In the case where the user does not lock the window due to an inadvertent mistake, there is a risk of intruder access to the window.

In order to cope with such problems, the present applicant has proposed a window device having an anti-crime function disclosed in Korean Patent Application No. 10-2008-0049593. This window device proposed by the present applicant is constructed such that it includes: a recess member joined to one of a window frame and a window and having a plurality of engagement elements formed thereon at regular intervals in the sliding direction of the window; a locker installed in the other of the window frame and the window so as to be engaged with the engagement elements of the recess member to maintain a locked state of the recess member and the locker; and a locking member disposed in the indoor direction of the window frame and having a key unit configured to release the locked state of the recess member and the locker.

Likewise, it can be expected that the window device having an anti-crime function proposed by present applicant through the earlier application will have the following effects.

The window device allows a crime-preventing function to be performed while maintaining a basic structure of a window.

The window device allows the window to be opened only indoors and to be freely opened the window even in any desired position within the window frame.

The window device can minimize exposure of the construction for prevention of crimes through an appearance of the window.

The window device can provide a security function while minimizing a modification in the structure of a general window frame and window.

The window device can easily maintain and repair the window after the crime-preventing function is bestowed to the window.

Therefore, the present inventor has simply and easily implemented a structure for performing the locking function while maintaining the technical spirit of the window device having the anti-crime function proposed through the earlier application, and thus has completed the prevent invention so as to be more easily applied to various forms of windows and window frames, which have been provided previously.

DISCLOSURE OF INVENTION

Accordingly, the present invention has been made in order to satisfy the above-mentioned necessities, and it is an object of the present invention to provide a novel type of locking device for windows, which simply and easily implements a structure for performing the locking function while maintaining the technical spirit of the window device having the anti-crime function proposed by the present inventor through an earlier application (i.e., Korean Patent Application No. 10-2008-0049593 entitled "Window Device having Anti-Crime Function") so as to be more easily applied to various forms of windows and window frames, which have been provided previously.

In particular, another object of the present invention is to provide a novel locking device for windows, which is configured to include a window side-locking unit 20 installed in a window 2 and a window frame side-locking unit 60 installed in the window frame 1, thereby minimizing a structural change in an existing window and window frame in application of the locking device, facilitating the assembly of the window side-locking unit 20 and the window frame side-locking unit 60, and allowing an inner window and an outer window to be locked effectively, respectively, when applied to an double window.

To achieve the above objects, according to a feature of the present invention, there is provided a locking device for windows, which restrict the movement of a pair of sliding windows 2 installed in a window frame 1 and configured to be opened in opposite directions to each other while sliding to allow an anti-crime function to be given to the windows, the locking device including: a window side-locking unit 20 joined to a sliding side of each of the pair of sliding windows 2, the window side-locking unit including a plurality of engagement means 22 formed thereon at regular intervals along a sliding direction of each of the pair of sliding windows 2; and a window frame side-locking unit 60 provided in a single number correspondingly to the pair of sliding windows 2 in such a fashion as to be disposed at the center of the window frame 1, i.e., at a portion in which the pair of sliding windows 2 in a state of being closed are overlapped with other so as to be opposed to the window side-locking units 20 respectively formed in the pair of sliding windows 2, so that the window frame side-locking unit is engaged to the window side-locking unit 20 to fix the position of the window 2, wherein the window frame side-locking unit 60 includes: a stop member 40 positioned at the center of the window frame 1, i.e., at a portion in which the pair of sliding windows 2 are overlapped with other, the stop member 40 being configured to be vertically moved in a direction perpendicular to the sliding direction of the windows 2 so as to be engaged to or disengaged from the engagement means 22 such that the engagement is maintained between the stop member 40 and the engagement means 22 at the normal time when no external force is exerted on the stop member 40; and a manipulation lever 62 configured to be exposed to the indoor side of the window frame 1 to allow a user to vertically move the stop member 40 through manipulation of the manipulation lever 62, whereby each of the sliding window 2 is separately engagingly fixed to the window frame side-locking unit 60 by the stop member 40 positioned at the center of the window frame 1 to cause restriction of its movement to continue to be maintained at the normal time when no external force is exerted on the manipulation lever 62 either at a position where each of the sliding windows 2 installed in the window frame 1 is completely closed or opened, or at an any arbitrary sliding position between the positions where each of the sliding window 2 is closed and opened, and each of the sliding window 2 is disengaged from the window frame side-locking unit 60 so as to be allowed to be moved only when the stop member is depressed downwardly by the turning of the manipulation lever 62.

In the locking device for windows of the present invention, the window side-locking unit 20 comprises a flat plate 221 having a plurality of holes 23 formed thereon at regular intervals along the sliding direction of each of the pair of sliding windows 2 so that the holes serves as the engagement means 22.

In the locking device for windows of the present invention, the stop member 40 of the window frame side-locking unit 60 is installed such that an elastic force is applied to the direction of the window side-locking unit 20 by means of a spring 48, so that when the user desires to adjust the opening of the window 2, he or she turns the manipulation lever 62 to cause the stop member 40 to be moved in an opposite direction to that of the window side-locking unit 20.

In the locking device for windows of the present invention, the stop member 40 of the window frame side-locking unit 60 includes: a fixed bar 46 installed at a lower portion thereof; a feed block 43 joined to the fixed bar 46 so as to be slidably moved in the direction of the window side-locking unit 20, the feed block being supported by the spring 48 such that the feed block is applied with an elastic force to the direction of the window side-locking unit 20 and is moved in an opposite direction to that of the window side-locking unit 20 by the turning of the manipulation lever 62; and a stop bar 42 releasably joined to the feed block 43 and engaged to or disengaged from the engagement means 22 of the window side-locking unit 20, the stop bar 42 being separately joined to the window frame side-locking unit 60 after the window frame side-locking unit 60 is installed in the window frame 1.

In the locking device for windows of the present invention, the window frame side-locking unit 60 further includes: a casing 80 detachably mounted to the window frame 1 such that the manipulation lever 62 is joined to the casing 80 so as to be exposed to the indoor side of the window frame 1, wherein the fixed bar 46 and the feed block 43 of the stop member 40 are accommodated within the casing 80; a rotary shaft 64 rotatably supported within the casing 80 and joined with the manipulation lever 62; and a connecting rod 70 rotatably fittingly mounted at one end thereof to the rotary shaft 64 and connected at the other end thereof with the feed block 43 of the stop member 40, the connecting rod 70 including a guide slot 76 penetratingly formed thereon by a predetermined length along a circumferential direction thereof, wherein a pin 68 mounted on the rotary shaft 64 is fitted into the guide slot 76 so that the connecting rod 70 is rotated by rotation of the rotary shaft 64 while being maintained in a free state on the rotary shaft 64.

EFFECT OF THE INVENTION

According to the locking device for windows of the present invention as constructed above, the window side-locking unit (20) installed in the window (2) and the window frame side-locking unit (60) installed in the window frame (1) are constructed such that the stop member (40) of the window frame side-locking unit (60) is engaged to the engagement means (22) of the window side-locking unit (20) through the vertical movement thereof to restrict the movement of the window, so that fabrication, maintenance and repair of the locking device are facilitated by a relatively simple construction, and the locking apparatus can be implemented in a relatively small size. Especially, the locking device according to the present invention enables the stop member (40) to be disengaged from the engagement means (22) of the window side-locking unit (20) by the turning of a manipulation lever (62) of the window frame side-locking unit (60), thereby facilitating assembly thereof and minimizing abrasion between components caused by the engagement of a locking element. In addition, in case of a double window, an inner window and an outer window can be separately moved, and thus the open positions of the inner and outer windows can be differently arranged in use.

EXPLANATION ON REFERENCE NUMERALS OF MAIN ELEMENTS OF THE DRAWINGS

| | |
|---|---|
| 1: window frame | 2: window |
| 10: locking device for windows | |
| 20: window side-locking unit | |
| 21: plate | 22: engagement means |
| 23: hole | 40: stop member |
| 42: stop bar | 43: feed block |
| 46: fixed bar | 48: spring |
| 60: window frame side-locking unit | |
| 62: manipulation lever | |
| 64: rotary shaft | 68: pin |
| 70: connecting rod | 76: guide slot |
| 80: casing | |

BEST MODE FOR CARRYING OUT THE INVENTION

Now, preferred embodiments of the present invention will be described hereinafter in more detail with reference to FIGS. 1 to 12.

Figure 1:
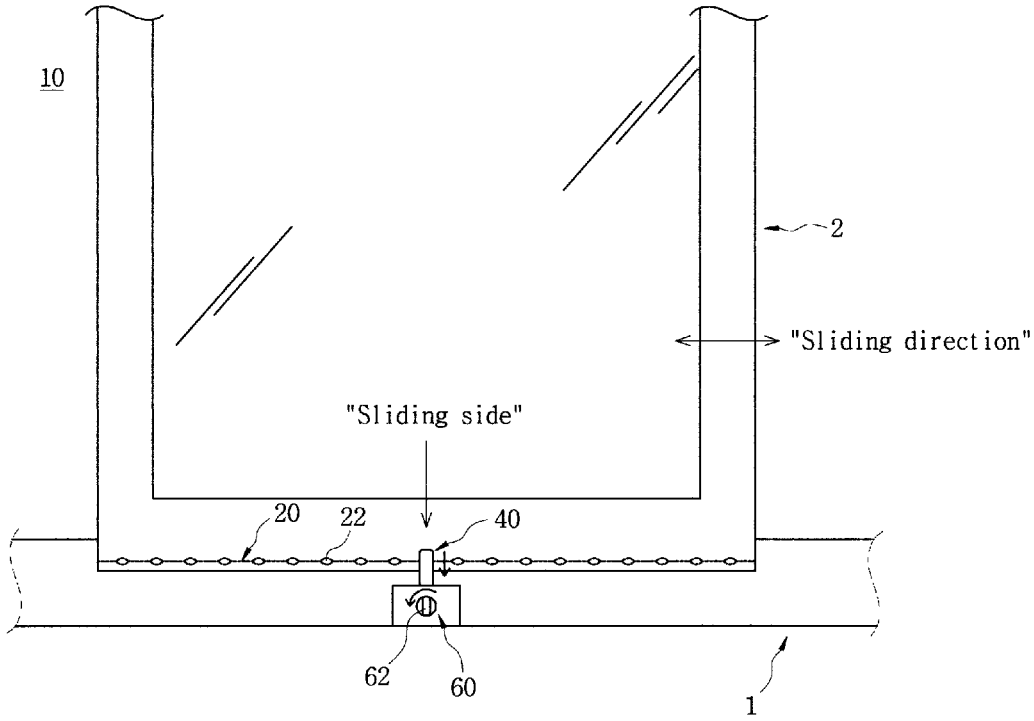
FIG. 1 is a schematic diagrammatic view for explaining a technical spirit of a locking device for windows in accordance with the present invention.

FIG. 1 is a schematic diagrammatic view for explaining a technical spirit of a locking device for windows in accordance with the present invention.

Referring to FIG. 1, a locking device 10 for windows in accordance with the present invention is characterized in that it includes a window side-locking unit 20 installed in the window 2 and a window frame side-locking unit 60 installed in the window frame 1, so that a stop member 40 of the window frame side-locking unit 60 is engaged to an engagement means of the window side-locking unit 20 through the vertical movement thereof to restrict the movement of the window, thereby bestowing an anti-crime function to the window 2.

In the locking device 10 for windows according to the present invention, the window side-locking unit 20 is joined to a sliding side of a sliding window 2 and includes a plurality of engagement means 22 formed thereon at regular intervals along a sliding direction of the sliding window 2. Also, the window frame side-locking unit 60 is installed in the window frame 1 so as to be opposed to the window side-locking unit 20 so that the window frame side-locking unit is engaged to the window side-locking unit 20 to fix the position of the window 2. In this case, the window frame side-locking unit 60 includes: a stop member 40 configured to be vertically moved in a direction perpendicular to the sliding direction of the window 2 so as to be engaged to or disengaged from the engagement means 22; and a manipulation lever 62 configured to be exposed to the indoor side of the window frame 1 to allow a user to vertically move the stop member 40 through manipulation of the manipulation lever 62.

The term "sliding direction", as used herein, refers to a direction in which a window is opened or closed. Typically, the sliding direction means the left and right direction based on a direction in which a person views. In addition, the term "sliding side", as used herein, refers to a side at which the window 2 is supported on the window frame 1. Typically, the sliding side means the upper and lower side based on a direction in which a person views. Also, in a preferred embodiment of the present invention, the window 2, there is shown a structured in which a roller 6 (see FIG. 2) slides along a sliding surface 1*b* (see FIG. 2) of the window frame 1 while being in close contact with the sliding surface 1*b*. This sliding structure of the window 2 may adopt various forms proposed in the art.

In the meantime, in the present invention, although the window side-locking unit 20 is constructed by adopting the form of a flat plate 21 (see FIG. 3) as shown in the preferred embodiment of the present invention, it may be constructed by adopting various forms such as an injection-molded form of a plastic material, a form molded by forging or casting, a form employing a pipe or a tube, and the like.

In addition, in the preferred embodiment of the present invention, although the engagement means 22 is constructed to include circular holes 23 that can be formed through press working or machining, it may include structures of various shapes such as groove or projection as well as holes of various shapes such as circular, oval, and polygonal shapes.

Figure 4:
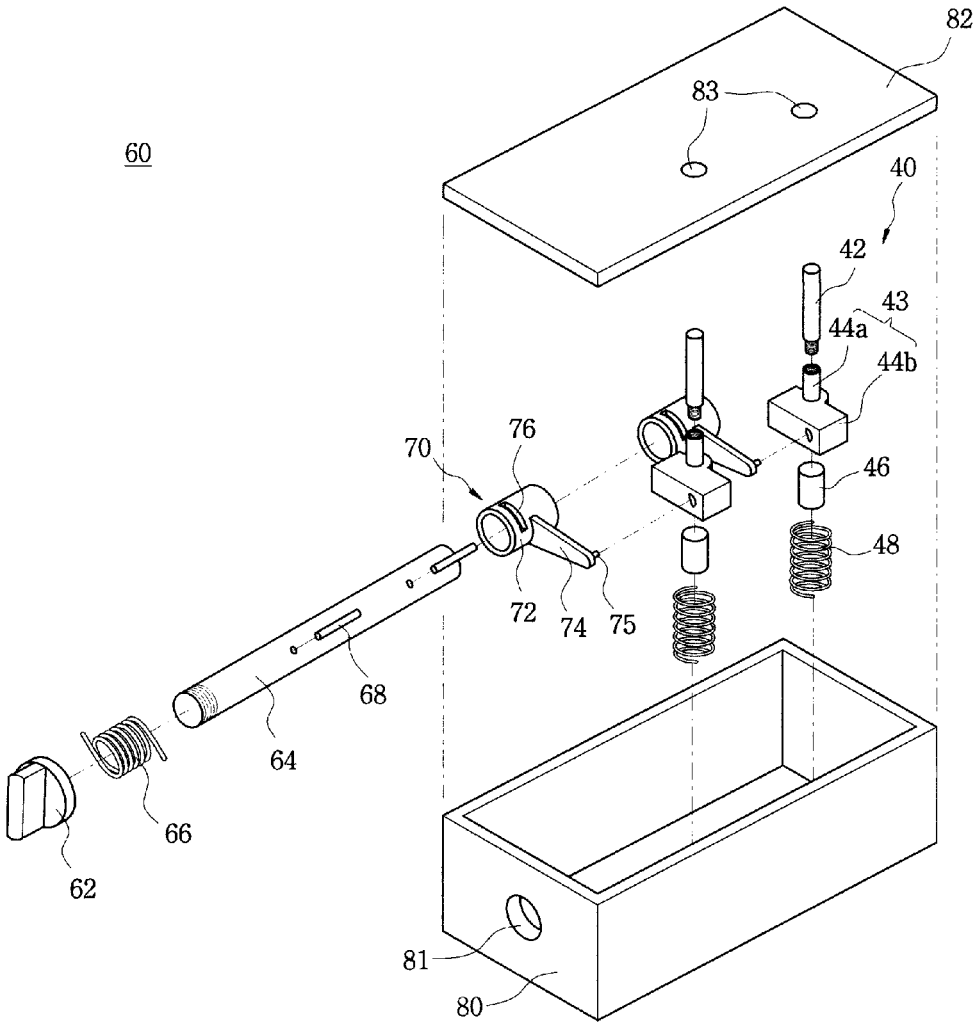
FIG. 4 is an exploded perspective view for explaining a window frame side-locking unit of a locking device for windows in accordance with a preferred embodiment of the present invention.

Meanwhile, in the present invention, the window frame side-locking unit 60 may adopt various mechanisms that allows the stop member 40 engaged to or disengaged from the engagement means 22 of the window side-locking unit 20 to be vertically moved in the direction of the window side-locking unit 20 by the turning of the manipulation lever 62. For example, in the preferred embodiment of the present invention, as shown in FIG. 4, the window frame side-locking unit 60 is constructed to include a mechanism consisting of a rotary shaft 64 that is rotated by the turning of the manipulation lever 62, a connecting rod 70 that is angularly moved by the rotation of the rotary shaft 64, a feed block 43 that is vertically moved by the rotation of the connecting rod 70, and a stop bar 42 that is releasably joined to the feed block 43 and engaged to or disengaged from the engagement means 22.

Such a window frame side-locking unit 60 shows the most preferred embodiment of the present invention, and may adopt various forms of operational mechanism that can be applied in the art. In particular, in the preferred embodiment of the present invention, the window frame side-locking unit 60 is constructed such that the stop member 40 receives an elastic force applied by a spring 48 in the direction window side-locking unit 20. Thus, restriction of movement of the window 2 continues to be maintained at the normal time when no external force is exerted on the stop member 40, and only when it is desired to move the window 2, the manipulation lever 62 is manipulated to improve an anti-crime function of the window 2 and eliminate the necessity of inconveniently securing the window.

Now, the preferred embodiment of the present invention will be described hereinafter in detail with reference to FIGS. 2 to 12. In FIGS. 1 to 12, elements performing the same function are denoted by identical reference numerals. In the meantime, in providing the locking device for windows according to the present invention, since the construction of a sash, a window frame, and rolling for a general sliding operation of the window can be easily applied through technologies of this field and a related field, illustration and detailed description of the technical contents that can be typically understood by those skilled in the art will be omitted, and only portions related with the present invention will be shown and described.

Figure 2:
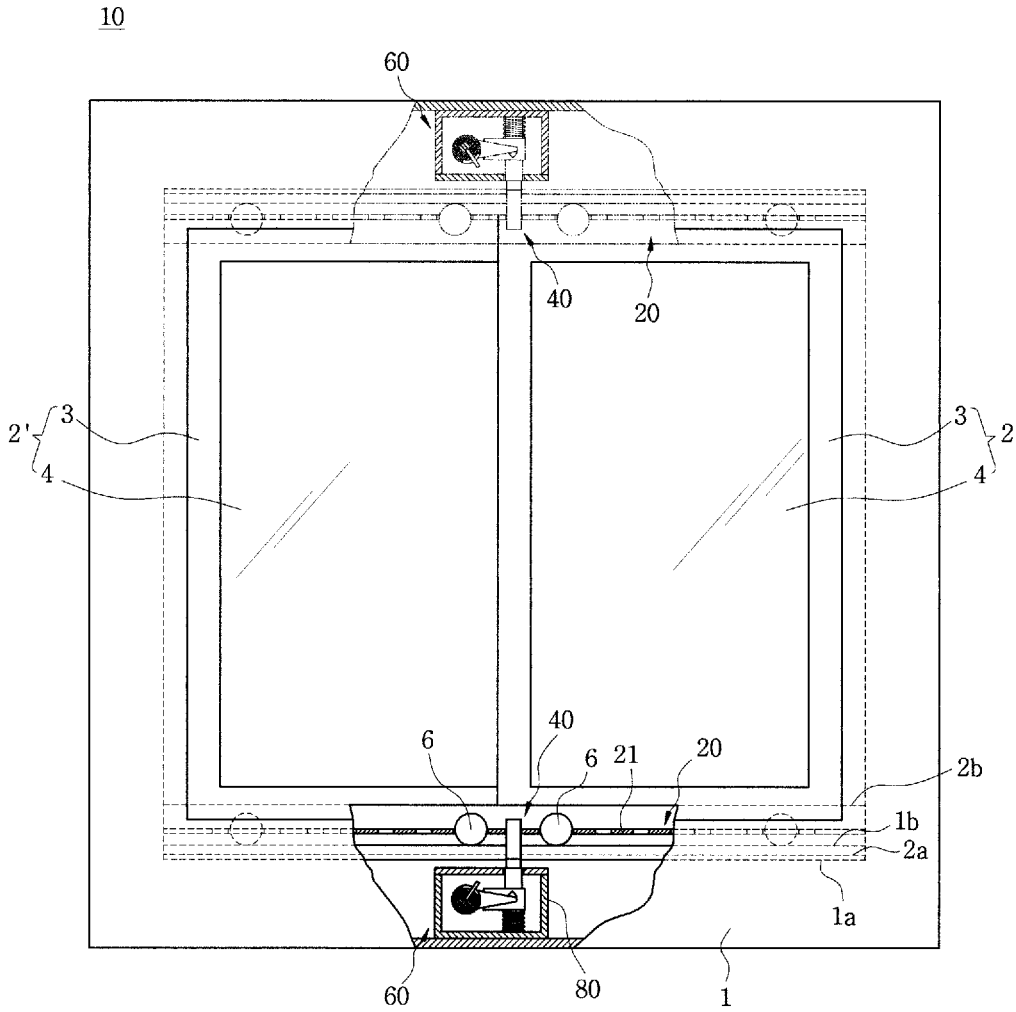
FIG. 2 is a schematic diagrammatic view for explaining an applicable form of a locking device for windows in accordance with a preferred embodiment of the present invention.

FIG. 2 is a schematic diagrammatic view for explaining an applicable form of a locking device for windows in accordance with a preferred embodiment of the present invention.

Referring to FIG. 2, the locking device 10 for windows according to the preferred embodiment of the present invention may be installed in any one of the upper and lower sliding sides of a pair of windows 2 and 2', and a window frame 1 on which the windows 2, and 2' are mounted. The windows 2 and 2' consist of sashes 3 and 3' and glazings 4 and 4' mounted to the inner edges of the sashes 3 and 3', and are horizontally moved slidably. In this case, the pair of windows 2 and 2' are sliding windows that are configured to be opened in opposite directions to each other. Any one side of the upper side and the lower side is used as a sliding side, and a roller 6 is rolled on a sliding surface 1*b* of the window frame 1 to perform a smooth sliding movement.

Figure 10:
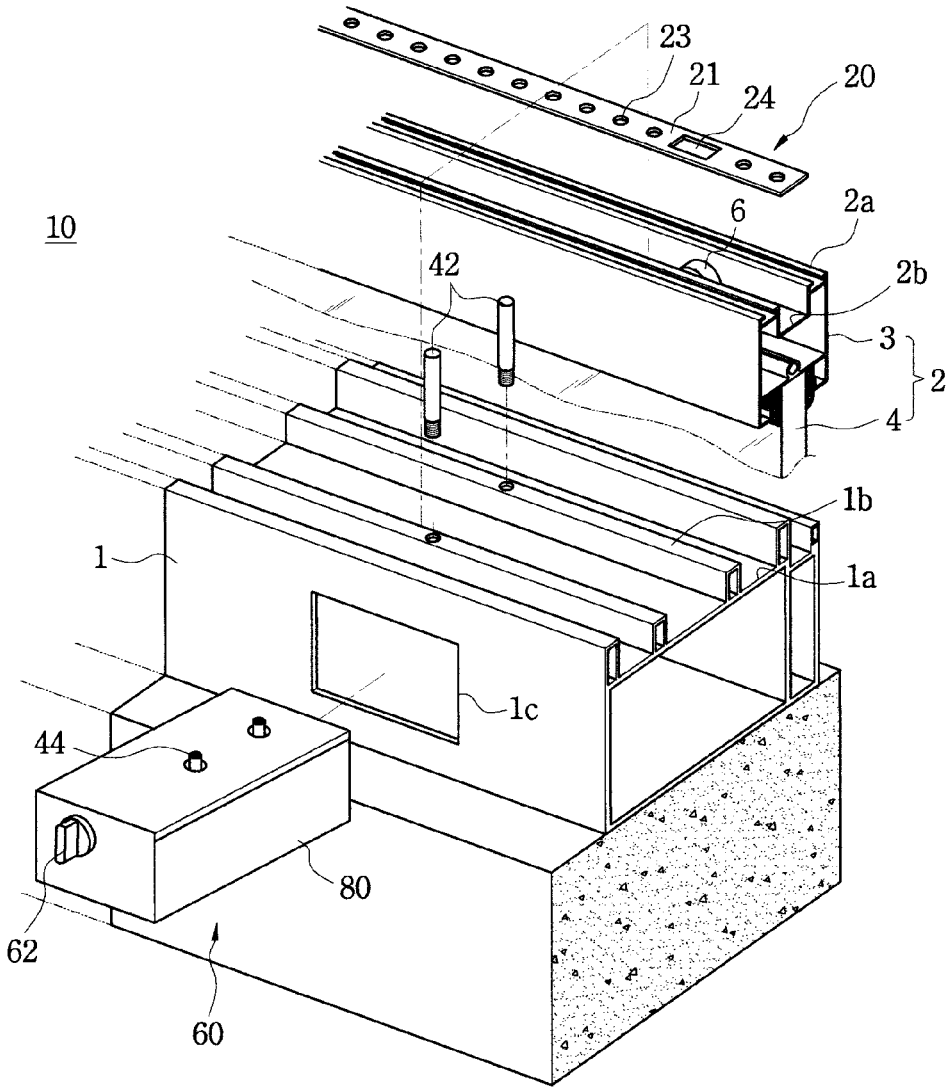
FIGS. 10 and 11 are perspective view for explaining the installation relationship between a window side-locking unit and a window frame side-locking unit in a locking device for windows in accordance with a preferred embodiment of the present invention.

In addition, in FIG. 1, reference numeral 1*a* denotes a top surface of the window frame 1, which defines a sliding space to which the window 2 is joined as shown in FIG. 10. Reference numeral 2*a* denotes a bottom surface of the window 2, which is positioned in the sliding space of the window frame 1, and reference numeral 2*b* denotes a top surface of an inner space recessedly formed in the sash 3 to allow the sliding surface 1*b* of the window frame 1 to be accommodated therein. Such a configuration is due to a general engagement structure of the window frame and the window. Thus, the reference numerals 1*a*, 1*b*, 2*a* and 2*b* means places to which the engagement structure of the window frame and the window can be applied. This engagement structure can be variously provided.

The locking device 10 for windows according to the preferred embodiment of the present invention includes the window side-locking unit 20 installed in the windows 2 and 2', and the window frame side-locking unit 60 installed in the window frame 1. The window side-locking unit 20 is joined to a sliding side of windows 2, and includes a number of engagement means 22 formed thereon at regular intervals along a sliding direction of the window 2.

Also, the window frame side-locking unit 60 includes a stop member 40 engaged to or disengaged from the engagement means 22, and is installed in the window frame 1 so as to be opposed to the window side-locking units 20, so that the window frame side-locking unit is engaged to the window side-locking unit 20 to fix the position of the window 2. In this case, the locking device 10 for windows according to the preferred embodiment of the present invention is constructed such that a pair of window side-locking units 20 and the window frame side-locking unit 60 are disposed at the center of the window frame 1, i.e., at a portion in which the pair of sliding windows 2 and 2' in a state of being closed are overlapped with other. The reason for this is that although the windows 2 and 2' is placed at any arbitrary position while sliding, they can be engagingly fixed by the pair of window side-locking units 20 and the window frame side-locking unit 60. Typically, the pair of windows 2 and 2' are installed in a laterally staggered arrangement relative to each other. In the preferred embodiment of the present invention, the pair of windows 2 and 2' are constructed so as to be separately locked. The pair of windows 2 and 2' perform the same function, and thus the windows are denoted by 2 as a representative reference numeral, which will be described hereinafter.

Figure 3:
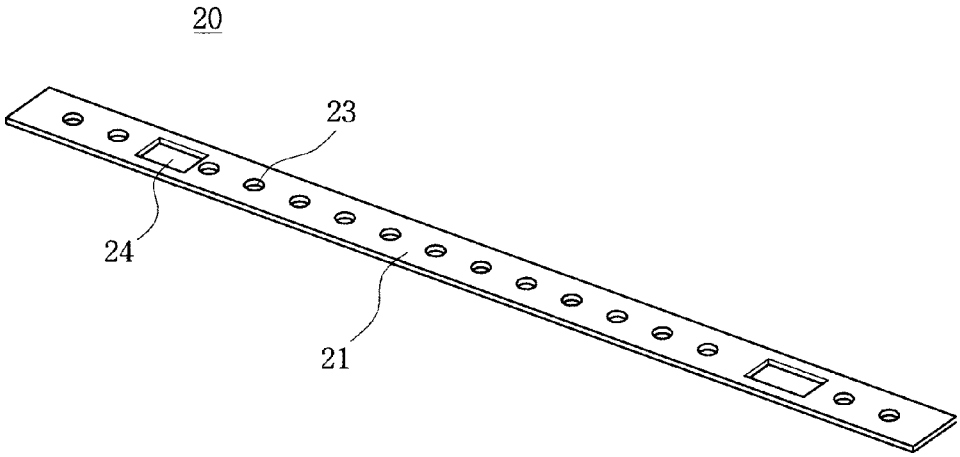
FIG. 3 is a perspective view for explaining a window side-locking unit of a locking device for windows in accordance with a preferred embodiment of the present invention.
Figure 5:
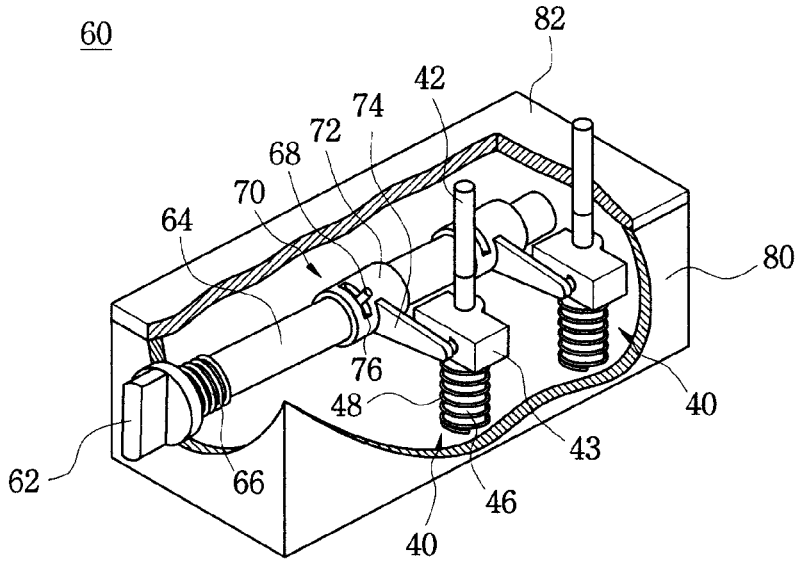
FIG. 5 is a partially cutaway perspective view of a casing in a state where a window frame side-locking unit is assembled in a locking device for windows in accordance with a preferred embodiment of the present invention.
Figure 6:
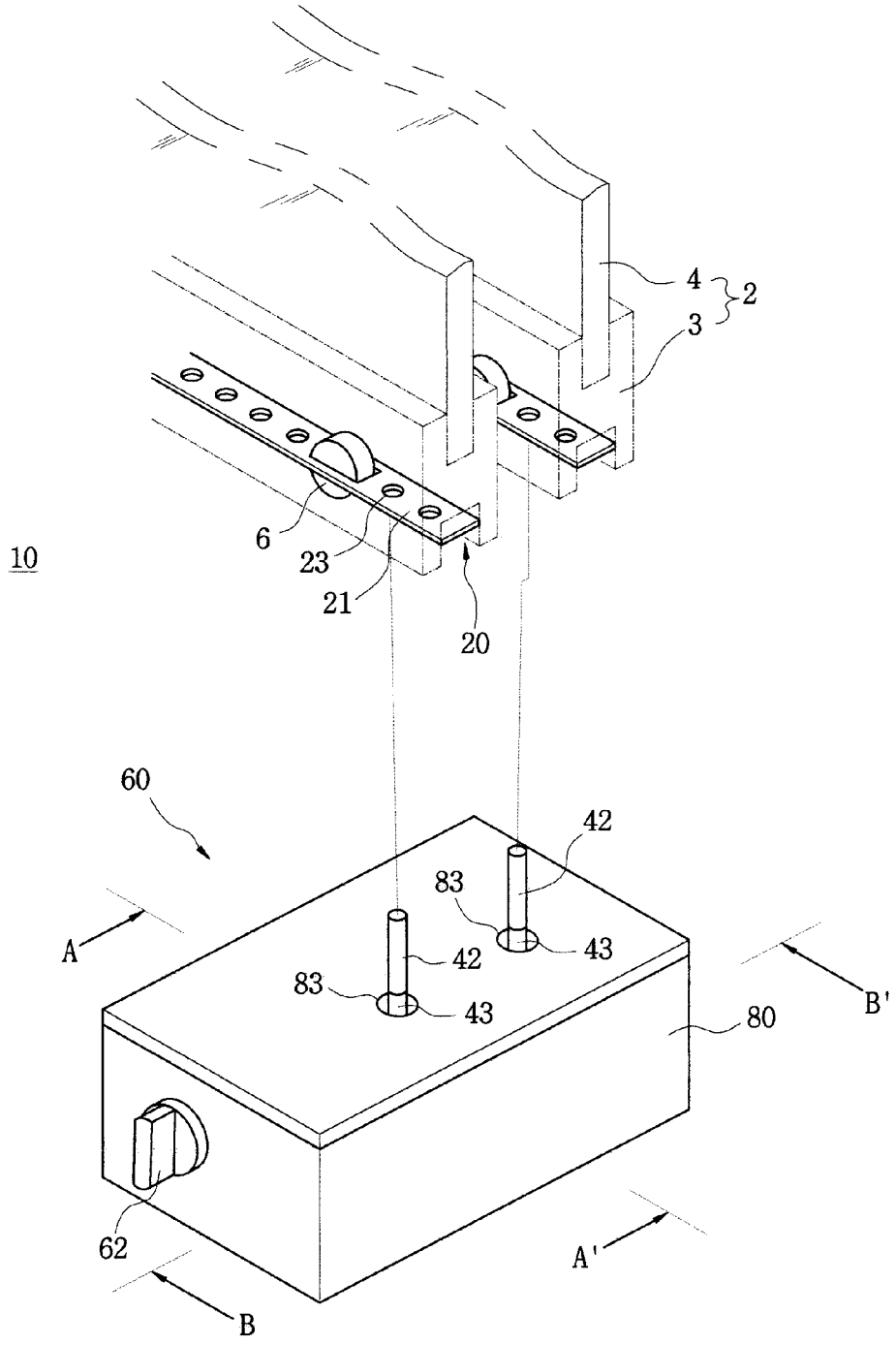
FIG. 6 is a perspective view illustrating the corresponding relationship between a window side-locking unit and a window frame side-locking unit in a locking device for windows in accordance with a preferred embodiment of the present invention.
Figure 7:
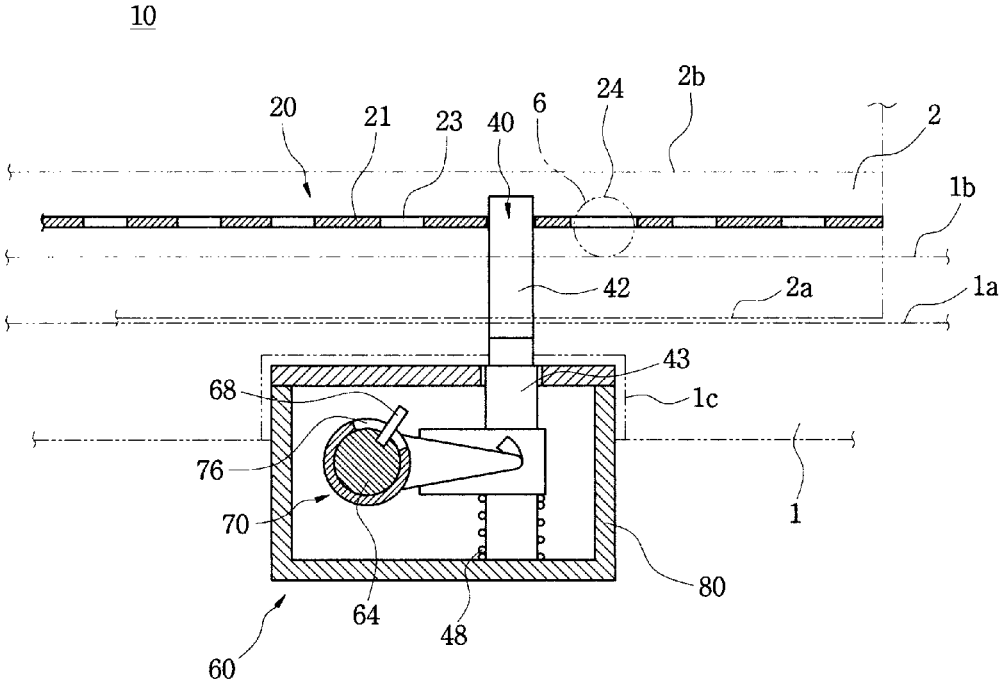
FIG. 7 is a schematically cross-sectional view taken along the line A-A' in FIG. 6.
Figure 8:
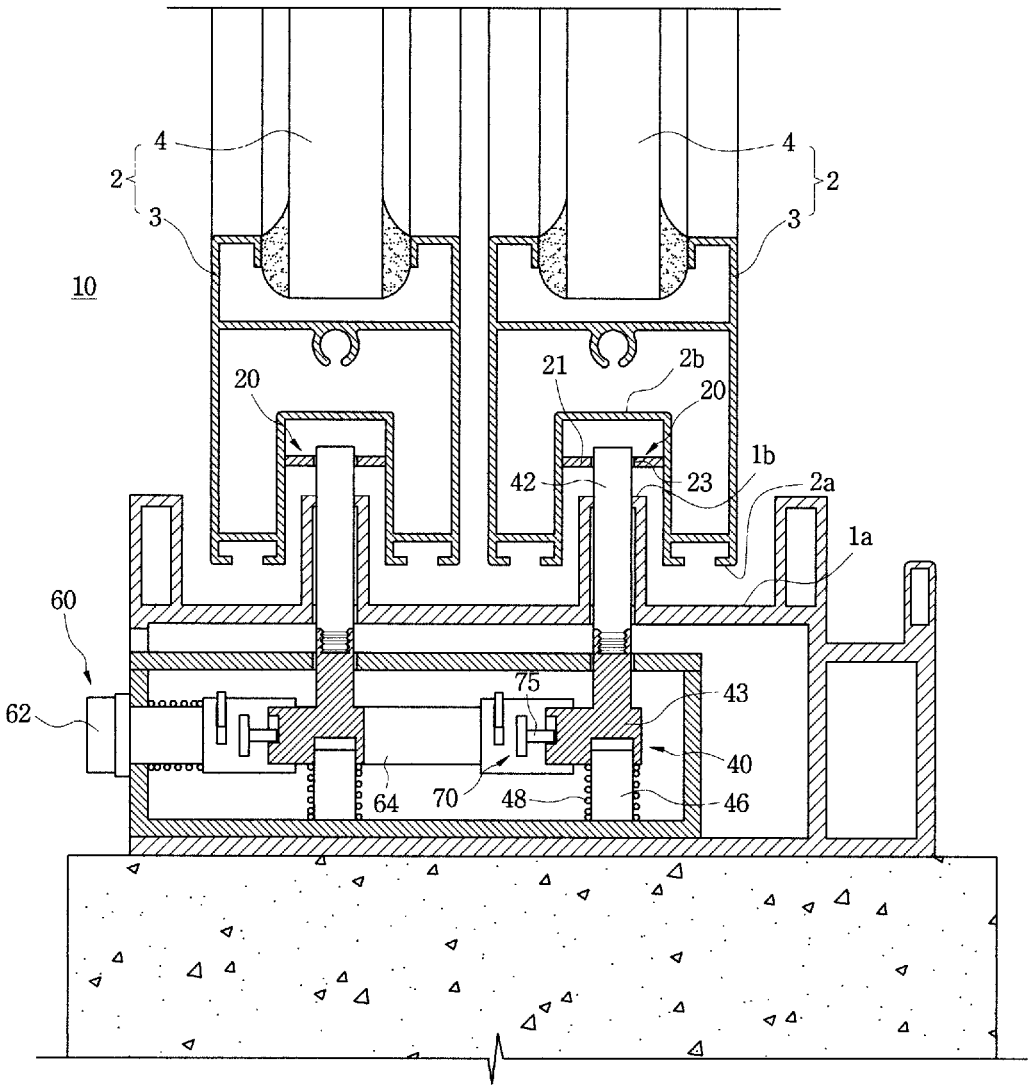
FIG. 8 is a schematically cross-sectional view taken along the line B-B' in FIG. 6.
Figure 9:
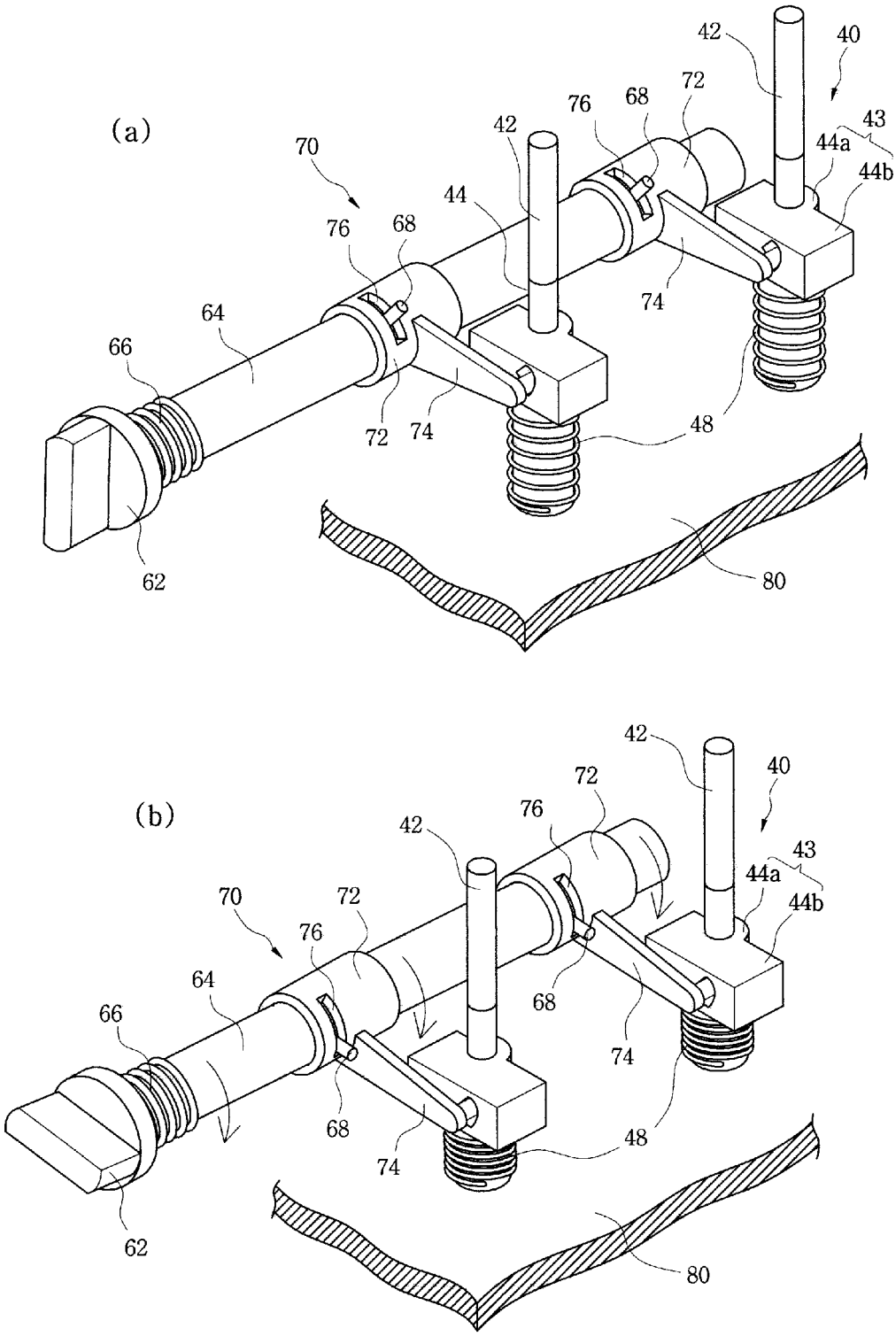
FIG. 9 is a perspective view for explaining an operating state of the stop member in a locking device for windows in accordance with a preferred embodiment of the present invention.
Figure 11:
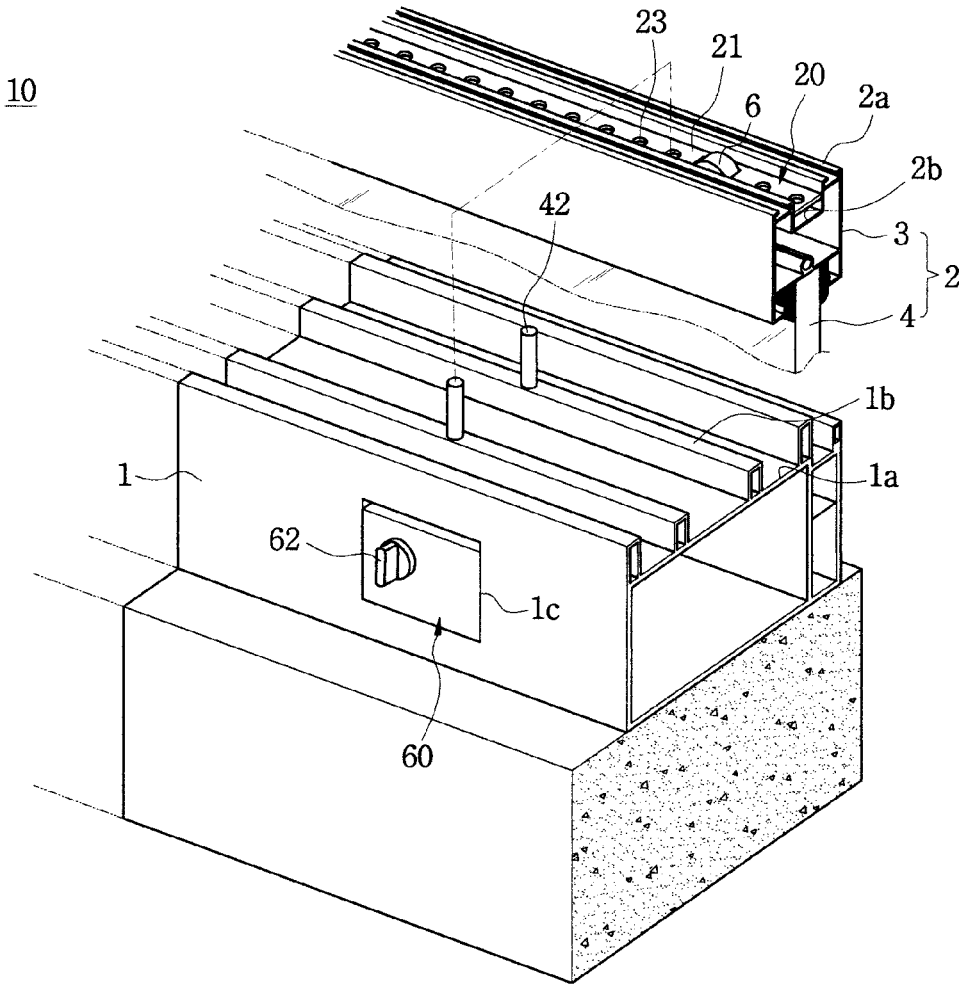
Figure 12:
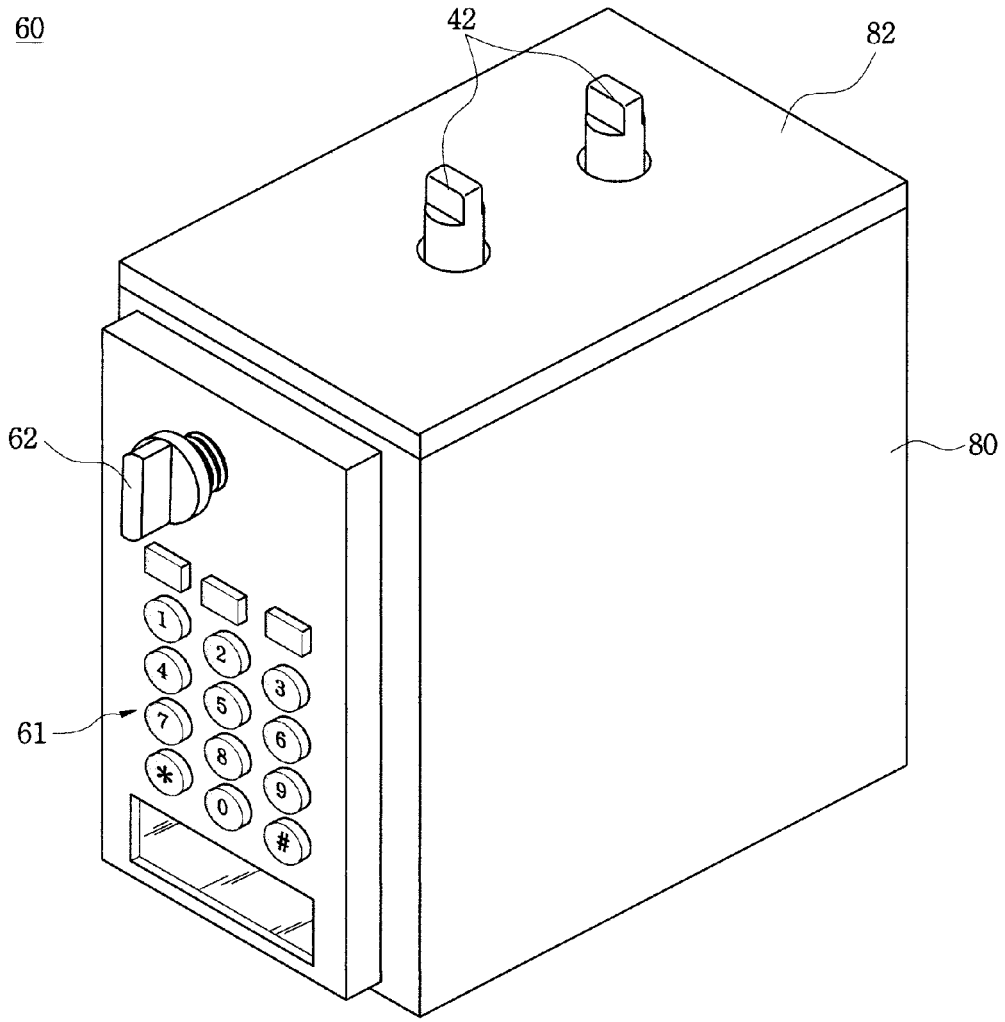
FIG. 12 is a perspective view illustrating a lock module in which an operational mechanism of the window frame side-locking unit is installed together to enable digital manipulation in a locking device for windows in accordance with another preferred embodiment of the present invention.

FIG. 3 is a perspective view for explaining a window side-locking unit of a locking device for windows in accordance with a preferred embodiment of the present invention, FIG. 4 is an exploded perspective view for explaining a window frame side-locking unit of a locking device for windows in accordance with a preferred embodiment of the present invention, FIG. 5 is a partially cutaway perspective view of a casing in a state where a window frame side-locking unit is assembled in a locking device for windows in accordance with a preferred embodiment of the present invention, FIG. 6 is a perspective view illustrating the corresponding relationship between a window side-locking unit and a window frame side-locking unit in a locking device for windows in accordance with a preferred embodiment of the present invention, FIG. 7 is a schematically cross-sectional view taken along the line A-A' in FIG. 6, FIG. 8 is a schematically cross-sectional view taken along the line B-B' in FIG. 6, FIG. 9 is a perspective view for explaining an operating state of the stop member in a locking device for windows in accordance with a preferred embodiment of the present invention, FIGS. 10 and 11 are perspective view for explaining the installation relationship between a window side-locking unit and a window frame side-locking unit in a locking device for windows in accordance with a preferred embodiment of the present invention, and FIG. 12 is a perspective view illustrating a lock module in which an operational mechanism of the window frame side-locking unit is installed together to enable digital manipulation in a locking device for windows in accordance with another preferred embodiment of the present invention.

Referring to FIG. 3, in the locking device 10 for windows according to the preferred embodiment of the present invention, the window side-locking unit 20 includes a flat plate 21 having a number of holes 23 formed thereon at regular intervals along the sliding direction of the window 2. In this case, the holes 23 are formed to serve as the engagement means 22. As shown in FIGS. 7 and 8, the plate 21 is installed below the sliding side of the window 21 so as to be positioned above the sliding surface 1*b* of the window frame 1.

The window side-locking unit 20 includes roller openings 24 formed on the plate 21 so as not to interfere with rollers 6 that are typically installed in the structure of the sliding window. In addition, the holes 23 formed on the plate 21 are arranged in a row along the sliding direction of the window 2. The holes 23 are formed to have the size and shape which allows the stop member 40 installed in the window frame 1, i.e., the stop bar 42 of the stop member 40 in this embodiment to be inserted thereto so that the stop member 40 inserted into the holes causes the window 2 to be engagingly fixed to the window frame 1. The window side-locking unit 20 may be constructed such that the flat plate 21 has holes 23 formed in various shapes such as circular, oval, and polygonal shapes through press working or drilling. In this case, the flat plate 21 is made of a stainless steel material. It is to be of course noted that the flat plate 21 may be made of a metal or non-metal material, a synthetic resin material such as PVC, and the like.

In the meantime, the plate 21 according to the preferred embodiment of the present invention has a number of holes 23 formed thereon to both sides of a roller opening 24 so that although each of both windows 2 installed in the window frame 1 is placed at a position where it is completely closed or opened, the movement of the window 2 can be restricted by the window frame side-locking unit 60 installed at the center of the window frame 1. In addition, the window side-locking unit according to the preferred embodiment of the present invention is constructed to conform to the width and length of a space defined at a lower side of the window 2 as shown in FIGS. 7 and 8. The window side-locking unit 20 is detachably installed in the window 2 so that it can be simply and conveniently replaced in the case where it is damaged or requires its maintenance and repair. Of course, the window side-locking unit 20 may be formed integrally with the window 2.

Referring to FIGS. 4 to 6, in the locking device 10 for windows according to the preferred embodiment of the present invention, the window frame side-locking unit 60 includes the stop member 40 inserted into the hole 23 serving as the engagement means 22 of the window side-locking unit 20 such that it is installed in the window frame 1 so as to be opposed to the window side-locking unit 20. The stop member 40 of the window frame side-locking unit 60 is installed so as to be protruded outwardly from the sliding surface 1*b* of the window frame 1.

In the meantime, in this embodiment, the stop member 40 is supported by a spring 48 to cause an elastic force to be applied to a direction perpendicular to the sliding direction of the window 2. The spring 48 allows the stop member 40 to be maintained in a state of being protruded in the direction of the window side-locking unit 20 when no external force is exerted on the stop member 40, i.e., when a user does not operate the stop member 40 by the turning of the manipulation lever 62. Thus, the stop member 40 is inserted into the hole 23 of the plate 21 so that a state continues to be maintained in which the movement of the window 2 is restricted. In this case, the movement of the window 2 is enabled only when the stop member 40 is depressed downwardly by the turning of the manipulation lever 62.

More specifically, the window frame side-locking unit 60 according to the preferred embodiment of the present invention includes a casing 80 detachably mounted to the window frame 1 such that the manipulation lever 62 is joined to the casing 80 so as to be exposed to the indoor side of the window frame 1, and a fixed bar 46 and a feed block 43 of the stop member 40 are accommodated within the casing 80. The casing 80 has a frame structure for supporting other constituent elements to be installed. In this embodiment, the casing 80 is covered at the top thereof by a cover 82, and has a hole 82 formed on a front surface (i.e., a surface directed to the indoor side) thereof so as to allow a rotary shaft 64 joined with the manipulation lever 62 to pass therethrough. In addition, the cover 82 has a hole 83 formed thereon so as to allow the stop member 40 to be upwardly and outwardly protruded therethrough. Of course, although not shown, a separate fixing structure will be generally applied to the casing 80 in various manners in this field to support the spring 48 and 66, the fixed bar 46, the rotary shaft 64, and the like.

In this case, the stop member 40 includes the fixed bar 46, the feed block 43, and the stop bar 42. The fixed bar 46 is installed at a lower portion thereof in such a fashion as to be fixed to the casing 80. The feed block 43 is joined to the fixed bar 46 so as to be slidably moved in the direction of the window side-locking unit 20, and is supported by the spring 48 such that the feed block is applied with an elastic force to the direction of the window side-locking unit 20 and is moved in an opposite direction to that of the window side-locking unit 20 by the turning of the manipulation lever 62. In this case, in this embodiment, although the feed block 43 is constructed to include a first connection part 44*a* having a screw thread formed at a top thereof so as to be engaged with the stop bar 42 and a second connection part 44*b* for connection with a connecting rod 70, which will be described later, it may be constructed in various forms in consideration of the operational relationship the feed block and other elements as well as the size of an allowable space. In addition, the stop bar 42 is releasably joined to the feed block 43 and engaged to or disengaged from the engagement means 22 of the window side-locking unit 20. In particular, in the preferred embodiment of the present invention, as shown in FIG. 10, the stop bar 42 may be separately joined to the window frame side-locking unit 60 after the window frame side-locking unit 60 is installed in the window frame 1 such that convenience of assembly is improved and the height of the window frame side-locking unit 60 is reduced, thereby decreasing the dimension of a space 1*c* (see FIGS. 7 and 10) to be defined in the window frame 1. In this case, the top end of the stop bar 42 may be formed in a block shape of a rectangular cross section having a width corresponding to the width of the sliding surface 1*b* of the window frame 1 as shown in FIG. 12 such that when a user turns the manipulation lever 62 to cause the stop bar 42 to be downwardly moved, the roller 6 can be stably and smoothly moved passing over the stop bar 42 while sliding along the sliding surface 1*b* of the window frame 1 upon the movement of the window 1. That is, the stop bar 42 is protruded upwardly from the sliding surface 1*b* of the window frame 1 as shown in FIGS. 7 and 8. When the stop bar 42 descends by the turning of the manipulation lever 62 so that the roller 6 installed in the window 2 slides along the sliding surface 1*b* while passing over the stop bar 42, the sliding surface 1*b* and the top end of the stop bar 42 are flush with each other to cause the roller 6 to slide stably and smoothly without generation of a noise.

In the meantime, the stop member 40 is downwardly moved by an operational mechanism operated by the turning of the manipulation lever 62 to enable the movement of the window 2. The operational mechanism includes a rotary shaft 64, a connecting rod 70, and a spring 66. The rotary shaft 64 is rotatably supported within the casing 80 and is joined with the manipulation lever 62. The connecting rod 70 is rotatably fittingly mounted at one end thereof to the rotary shaft 64 and is connected at the other end thereof with the feed block 43 of the stop member 40. In addition, the connecting rod 70 includes a guide slot 76 penetratingly formed thereon by a predetermined length along a circumferential direction thereof, and a pin 68 mounted on the rotary shaft 64 is fitted into the guide slot 76 so that the connecting rod 70 is rotated by rotation of the rotary shaft 64 while being maintained in a free state on the rotary shaft 64. The connecting rod 70 includes a hollow barrel 72 fitted around the rotary shaft 64, and a linkage 74 extending from the barrel 72 and having a protuberance 75 formed at a distal end thereof so as to be engagingly inserted into a groove formed at a side of the feed block 43. In this embodiment, the groove is formed in a circular arc shape in consideration of the fact that the connecting rod 70 is angularly moved. The spring 66 is fixed at one end thereof to either the manipulation lever 62 or the rotary shaft 64, and is fixed at the other end thereof to the casing 80. Thus, an elastic force is exerted on the manipulation lever 62 and the rotary shaft 64 in the turning direction of the manipulation lever 62 by the spring 66 such that when the user turns the manipulation lever 62 by a given angle and then releases the manipulation lever 62, the manipulation lever 62 automatically returns to its original position by an restoring force of the spring 66.

As shown in FIG. 9, the rotary shaft 64 and the connecting rod 70 of the operational mechanism are downwardly moved angularly by the turning of the manipulation lever 62 by the user so that the stop bar 42 descends. In other words, when the user turns the manipulation lever 62 in a state of FIG. 9(*a*), i.e., an initial state, the rotary shaft 64 is rotated as shown in FIG. 9(*b*) to cause the pin 68 of the rotary shaft 64 to be retained by an interior termination end of the guide slot 76 in a state of being inserted into the guide slot 76. Then, the connecting rod 70 is rotated together with the rotary shaft 64 to cause the feed block 43 of the stop member 40 to be downwardly moved so that the stop bar 42 is also downwardly moved.

The locking device 10 for windows according to the preferred embodiment of the present invention is constructed such that the window frame side-locking unit 60 can be replaceably installed. That is, as shown in FIGS. 10 and 11, when only a space 1*c* where to mount the window frame side-locking unit 60 is secured in the window frame 1, the window frame side-locking unit 60 is simply and conveniently installed in the space 1*c* and its replacement is performed simply and conveniently upon the maintenance and repair thereof. Thus, the installation space 1*c* where to install the window frame side-locking unit 60 in the window frame 1 is secured by a method such as cutting or the like so that the manipulation lever 62 is simply and conveniently installed in such a fashion as to be exposed to the indoor side of the window frame 1. Of course, such a configuration may be implemented in the manufacture of the window frame 1. In this case, as shown in FIG. 11, after the window frame side-locking unit 60 is joined to the window frame 1, the margin space 1*c* around the edges thereof is sealed. Also, in the window frame side-locking unit 60 according to the present invention, since the stop bar 42 is releasably joined to the feed block 43, the stop bar 42 is separately joined to the window frame side-locking unit 60 after the window frame side-locking unit 60 is installed in the window frame 1 such that convenience of assembly is improved and the height of the window frame side-locking unit 60 is reduced, thereby decreasing the dimension of the space 1*c* to be defined in the window frame 1.

The operation of the locking device 10 for windows according to the preferred embodiment of the present invention will be described hereinafter with reference to FIGS. 7 to 9.

First, the stop bar 42 of the stop member 40 receives an elastic force applied by the spring 48 so that it continues to be maintained in a state of being protruded upwardly from the sliding surface 1*b* of the window frame 1 unless any external force is exerted on the stop member 40. In this case, the external force applied to the stop member 40 is generated by the turning of the manipulation lever 62, and refers to a force compressing the spring 48 that applies the elastic force.

The stop bar 42 protruded upwardly from the sliding surface 1*b* of the window frame 1 is inserted into the hole 23 of the plate as the window side-locking unit 20 mounted in the window 2 so as to restrict the movement of the window 2. Since the hole 23 is arranged in plural numbers in a row on the plate 21 along the sliding direction of the window 2, the window 2 is retained by the stop bar 42 even in a state of being held in a specific position on the sliding surface 1*b* of the window frame 1 by using an internal between two adjacent ones of the plurality of holes 23 as a unit, so that the movement of the window 2 is prevented. Also, even in the case where the window 2 is opened, the locking device 10 for windows according to the preferred embodiment of the present invention prevents the movement of the window 2 to improve an anti-crime function. In this case, as the number of the holes 23 increases, an interval decreases in which the window 2 can be fixed on the sliding surface 1*b* of the window frame 1, thereby further improving the anti-crime function of the window 2.

In addition, in the locking device 10 for windows according to the preferred embodiment of the present invention, the stop bar 42 engagingly inserted into the hole 23 of the plate 21 is operated in cooperation with the manipulation lever 62. That is, the connecting rod 70 is rotated by the rotation of the rotary shaft 64 joined with the manipulation lever 62 so that the stop bar 42 is downwardly moved so as to be disengaged from the hole 23 and is inserted below the sliding surface 1*b* of the window frame 1. Also, since the connecting rod 70 is rotatably joined to the rotary shaft 64, the respective stop bars 42 are depressed by the respective plates 21 between the holes 23 of the respective plates 21 at different positions so that the respective stop bars 42 descend by different distances in the process in which the pair of windows 2 and 2' installed in the front and rear sides of the window frame 1 slide along the sliding surface 1*b* of the window frame 1 independently of each other in this embodiment as described above. Alternatively, although one side-stop bar 42 descends and the other side-stop bar 42 ascends, the free rotation of the connecting rod 70 prevents the rotary shaft 64 from being twisted to perform a locking function separately.

In the meantime, when the user turns the manipulation lever 62, the rotary shaft 64 is rotated together with the manipulation lever 62 and the pin 68 fixed to the rotary shaft 64 is retained by the internal termination end of the guide slot 76 of the connecting rod 70 to cause the connecting rod 70 to be rotated so that the feed block 43 connected to the connecting rod 70 descends. Thus, the stop bar 42 joined to the feed block 43 escapes from the hole 23 of the plate 21 to enable the movement of the window 2. On the other hand, when the user releases the turning of the manipulation lever 62, the spring 48 installed below the stop bar 42 returns to its original position to cause the stop bar 42 to be protruded outwardly from the plate 21 and the manipulation lever 62 to return to its original position.

FIG. 12 is a perspective view illustrating a lock module in which an operational mechanism of the window frame side-locking unit is installed together to enable digital manipulation in a locking device for windows in accordance with another preferred embodiment of the present invention.

Referring to FIG. 12, in the locking device 10 for windows according to the preferred embodiment of the present invention as described above, the window frame side-locking unit 60 is constructed to be manually manipulated by a user. However, in this embodiment, the window frame side-locking unit 60 may be constructed to further include a digital manipulation unit 61 including a driver such as an electromagnet for descending the stop bar 42, and a control panel in which any one selected from a keyboard and a keypad for inputting a password is installed. Thus, when the user inputs his or her password through the control panel of the digital manipulation unit 61, the stop bar 42 can descends automatically to enable the movement of the window 2. Of course, such a digital manipulation unit 61 is preferably installed together with an operational mechanism manipulated manually by the user as described above so that the user can manipulate manually it at an emergency time.

Further, in this embodiment, the digital manipulation unit 61 may include various functions including a function of generating an alarm sound when an external force is exerted on the window 2 or the window frame 1 by an intruder access to the window 2, a function of indicating the charge level of a power supply such as a battery used in the digital manipulation unit 61, a function of, when the stop bar 42 is not correctly inserted into the hole 23 of the plate 21, giving an alarm to inform this, etc., in addition to a function of descending the stop bar 42.

While the locking device for windows according to the preferred embodiments of the present invention has been described and illustrated in connection with specific exemplary embodiments with reference to the accompanying drawings, it will be readily appreciated by those skilled in the art that it is merely illustrative of the preferred embodiments of the present invention and various modifications and changes can be made thereto within the technical spirit and scope of the present invention.

MODE FOR INVENTION

To achieve the above objects, according to a feature of the present invention, there is provided a locking device for windows, which restrict the movement of a pair of sliding windows 2 installed in a window frame 1 and configured to be opened in opposite directions to each other while sliding to allow an anti-crime function to be given to the windows, the locking device including: a window side-locking unit 20 joined to a sliding side of each of the pair of sliding windows 2, the window side-locking unit including a plurality of engagement means 22 formed thereon at regular intervals along a sliding direction of each of the pair of sliding windows 2; and a window frame side-locking unit 60 provided in a single number correspondingly to the pair of sliding windows 2 in such a fashion as to be disposed at the center of the window frame 1, i.e., at a portion in which the pair of sliding windows 2 in a state of being closed are overlapped with other so as to be opposed to the window side-locking units 20 respectively formed in the pair of sliding windows 2, so that the window frame side-locking unit is engaged to the window side-locking unit 20 to fix the position of the window 2, wherein the window frame side-locking unit 60 includes: a stop member 40 positioned at the center of the window frame 1, i.e., at a portion in which the pair of sliding windows 2 are overlapped with other, the stop member 40 being configured to be vertically moved in a direction perpendicular to the sliding direction of the windows 2 so as to be engaged to or disengaged from the engagement means 22 such that the engagement is maintained between the stop member 40 and the engagement means 22 at the normal time when no external force is exerted on the stop member 40; and a manipulation lever 62 configured to be exposed to the indoor side of the window frame 1 to allow a user to vertically move the stop member 40 through manipulation of the manipulation lever 62, whereby each of the sliding window 2 is separately engagingly fixed to the window frame side-locking unit 60 by the stop member 40 positioned at the center of the window frame 1 to cause restriction of its movement to continue to be maintained at the normal time when no external force is exerted on the manipulation lever 62 either at a position where each of the sliding windows 2 installed in the window frame 1 is completely closed or opened, or at an any arbitrary sliding position between the positions where each of the sliding window 2 is closed and opened, and each of the sliding window 2 is disengaged from the window frame side-locking unit 60 so as to be allowed to be moved only when the stop member is depressed downwardly by the turning of the manipulation lever 62.

In the locking device for windows of the present invention, the window side-locking unit 20 comprises a flat plate 221 having a plurality of holes 23 formed thereon at regular intervals along the sliding direction of each of the pair of sliding windows 2 so that the holes serves as the engagement means 22.

In the locking device for windows of the present invention, the stop member 40 of the window frame side-locking unit 60 is installed such that an elastic force is applied to the direction of the window side-locking unit 20 by means of a spring 48, so that when the user desires to adjust the opening of the window 2, he or she turns the manipulation lever 62 to cause the stop member 40 to be moved in an opposite direction to that of the window side-locking unit 20.

In the locking device for windows of the present invention, the stop member 40 of the window frame side-locking unit 60 includes: a fixed bar 46 installed at a lower portion thereof; a feed block 43 joined to the fixed bar 46 so as to be slidably moved in the direction of the window side-locking unit 20, the feed block being supported by the spring 48 such that the feed block is applied with an elastic force to the direction of the window side-locking unit 20 and is moved in an opposite direction to that of the window side-locking unit 20 by the turning of the manipulation lever 62; and a stop bar 42 releasably joined to the feed block 43 and engaged to or disengaged from the engagement means 22 of the window side-locking unit 20, the stop bar 42 being separately joined to the window frame side-locking unit 60 after the window frame side-locking unit 60 is installed in the window frame 1.

In the locking device for windows of the present invention, the window frame side-locking unit 60 further includes: a casing 80 detachably mounted to the window frame 1 such that the manipulation lever 62 is joined to the casing 80 so as to be exposed to the indoor side of the window frame 1, wherein the fixed bar 46 and the feed block 43 of the stop member 40 are accommodated within the casing 80; a rotary shaft 64 rotatably supported within the casing 80 and joined with the manipulation lever 62; and a connecting rod 70 rotatably fittingly mounted at one end thereof to the rotary shaft 64 and connected at the other end thereof with the feed block 43 of the stop member 40, the connecting rod 70 including a guide slot 76 penetratingly formed thereon by a predetermined length along a circumferential direction thereof, wherein a pin 68 mounted on the rotary shaft 64 is fitted into the guide slot 76 so that the connecting rod 70 is rotated by rotation of the rotary shaft 64 while being maintained in a free state on the rotary shaft 64.

INDUSTRIAL APPLICABILITY

The present invention relates to a locking device for windows, and more particularly, to such a locking device for windows, which simply implements the constitution for performing a locking function while maintaining the technical spirit of a window device having an anti-crime function proposed through an earlier application by the present inventor, so that it can be more easily applied to various types of windows and window frames.

The invention claimed is:

1. A locking device for windows, which is configured restrict the movement of a window installed in a window frame to allow an anti-crime function to be given to the window, the locking device comprising:

a window side-locking unit joined to a sliding side of the window, the window side-locking unit including an engagement element formed thereon at regular intervals along a sliding direction of the window; and a window frame side-locking unit directly engaged with the window frame to correspond to the window side-locking unit, so that the window frame side-locking unit is engaged to the window side-locking unit to fix the position of the window, wherein the window frame side-locking unit comprises:

a stop member configured to be vertically moved in a direction perpendicular to the sliding direction of the window so as to be engaged to or disengaged from the engagement element; and a manipulation lever configured to be exposed to the indoor side of the window frame to allow a user to vertically move the stop member through manipulation of the manipulation lever, wherein the stop member of the window frame side-locking unit is installed such that an elastic force is applied to the direction of the window side-locking unit by a spring, so that when the user desires to adjust the opening of the window, he or she turns the manipulation lever to cause the stop member to be moved in an opposite direction to that of the window side-locking unit, and wherein the stop member of the window frame side-locking unit comprises:

a fixed bar installed at a lower portion of the window frame side-locking unit;

a feed block joined to the fixed bar so as to be slidably moved in the direction of the window side-locking unit, the feed block being supported by the spring inserted into the fixed bar such that the feed block is applied with an elastic force to the direction of the window side-locking unit and is moved in an opposite direction to that of the window side-locking unit by the turning of the manipulation lever; and a stop bar releasably joined to the feed block and engaged to or disengaged from the engagement element of the window side-locking unit, the stop bar being separately joined to the window frame side-locking unit after the window frame side-locking unit is installed in the window frame.

2. The locking device according to claim 1, wherein the window side-locking unit comprises a flat plate having a plurality of holes formed thereon at regular intervals along the sliding direction of the window so that the holes serve as the engagement element.

3. The locking device according to claim 1, wherein the window frame side-locking unit further comprises:

a casing detachably mounted to the window frame such that the manipulation lever is joined to the casing so as to be exposed to the indoor side of the window frame, wherein the fixed bar and the feed block of the stop member are accommodated within the casing;

a rotary shaft rotatably supported within the casing and joined with the manipulation lever; and a connecting rod rotatably fittingly mounted at one end thereof to the rotary shaft and connected at the other end thereof with the feed block of the stop member, the connecting rod including a guide slot penetratingly formed thereon by a predetermined length along a circumferential direction thereof, wherein a pin mounted on the rotary shaft is fitted into the guide slot so that the connecting rod is rotated by rotation of the rotary shaft while being maintained in a free state on the rotary shaft.

* * * * *